United States Patent [19]

Brodmann

[11] Patent Number: 4,812,139

[45] Date of Patent: Mar. 14, 1989

[54] DYED POLYESTER FABRICS WITH IMPROVED LIGHTFASTNESS

[75] Inventor: George L. Brodmann, Greensboro, N.C.

[73] Assignee: Burlington Industries, Inc., Greensboro, N.C.

[21] Appl. No.: 190,164

[22] Filed: May 4, 1988

[51] Int. Cl.[4] ..... D06P 5/02

[52] U.S. Cl. ..... 8/490; 8/115.58; 8/442; 8/573; 8/607; 8/922

[58] Field of Search ..... 8/490, 442, 573, 607

[56] References Cited

U.S. PATENT DOCUMENTS

| | | | |
|---|---|---|---|
| 3,880,875 | 4/1975 | Strobel et al. | 8/490 |
| 4,557,730 | 12/1985 | Bennett et al. | 8/442 |
| 4,668,235 | 5/1987 | Evans et al. | 8/115.58 |
| 4,737,155 | 4/1988 | Rollick et al. | 8/442 |

FOREIGN PATENT DOCUMENTS 255481 2/1988 European Pat. Off. .

OTHER PUBLICATIONS

"UV Stabilizers", *Kirk Othmer* 3rd edition, pp. 615–627.

"Photolytic Behavior of Some Popular Disperse Dyes on Polyester and Nylon Substrates", *Textile Research Institute,* Apr. 1987, pp. 223–234, Freeman et al.

"New Developments in the Stabilization of Automotive Paints", Dr. L. Avar et al, 1984, Annual Meeting Federation of Societies for Coatings Technology.

*Primary Examiner*—A. Lionel Clingman

*Attorney, Agent, or Firm*—Nixon & Vanderhye

[57] ABSTRACT

Photodegradation and light-stabilizing amounts of a combination of an oxalanilide UV absorber and a hindered amine light stabilizer are applied to a dyed polyester fabric providing a lightfastness rating of at least 4 AATCC Gray Scale following 100 hours WeatherOmeter exposure. Fabrics so protected are useful for automotive fabrics and draperies.

17 Claims, No Drawings

DYED POLYESTER FABRICS WITH IMPROVED LIGHTFASTNESS

Ultraviolet light absorbers in combination with light stabilizers are used to improve the lightfastness of polyester fabrics, especially for automotive fabrics and draperies.

BACKGROUND OF THE INVENTION

Continuous exposure to sunlight often causes photodegradation of the dye and slight to severe color changes in dyed synthetic fabrics, such as polyester or nylon. The photodegradation process is largely caused by ultraviolet (UV) radiation. The presence of heat and moisture accelerates the rate of photodecomposition.

It is a common practice in the textile dyeing art to use colorless UV absorbers in the dyeing process to improve the light stability of the resulting dyed textiles and protect the dyed textiles from photodegradation. The UV absorbers include benzophenones and benzotriazoles, which are organic molecules capable of absorbing UV light in the range of 290–400 nanometers, and which convert the absorbed incident radiation into harmless heat. Such UV absorbers improve the UV stability of the colored polyester textiles, but only to a limited extent. The improvement in UV stability is limited to 0.5–1 grade (Gray Scale) over 200 hours of UV exposure, and this occurs only when the maximum amount, typically 3 to 5% on the weight of the fabric (OWF), of the UV absorber is used. Little or no improvement is seen at lower UV light exposures, for instance in the range of 40–100 hours even using significant amounts of UV absorbers.

An object of this invention is to develop dyed polyester fabrics exhibiting improved resistance to fading by ultraviolet light. Desirably, a significant improvement of from one to two grades (Gray Scale), comparable with the most protected commerically-available UV-stabilized fabrics is achieved.

Fabric products provided by this invention and exhibiting maximum lightfastness are typically used for drapery or curtain materials, and as automotive textiles for seats and trim use.

DESCRIPTION OF THE INVENTION

A judicious choice of UV absorbers and light stabilizers from among such materials typically used in the plastic and paint industries, but not generally used on textiles, results in improved ultraviolet light protection for the dyed polyester fabrics. Optionally, a resin or softener may be incorporated into the treating formulation to improve durability and aesthetic properties, such as hand and luster of the treated polyester fabric.

The ultraviolet-protecting agents used in the process of this invention are soluble only in organic solvents, the preferred solvent being xylene, in which the chemical or chemicals selected must have a solubility of greater than 200 grams per liter. Solvents such as toluene, ethyl acetate and methylethyl ketone may also be considered. A combination of UV absorber plus light stabilizer is used. The UV absorber is generally selected from the oxalanilide group, while the light stabilizers are nickel-quenched sterically-hindered amines.

UV absorbers suited to the process of this invention are primarily benzophenones, benzotriazoles and the oxalanilides, all absorbing UV light in the range of 290–400 nanometers. The UV absorber may be selected from those in Kirk-Othmer, *Encylopedia of Chemical Technology,* 3rd Edition, Vol. 23, pp. 622–623, Table 2, the disclosure of which is hereby available from several commercial sources. A preferred group of resorcinol monobenzoates, phenyl salicylate and 2-hydroxybenzophenones are described in U.S. Pat. No. 4,557,730 (the disclosure of which is incorporated by reference) as solutions of U.V. absorbers useful for improving the lightfastness of dyeings on polyester, especially for polyester used in the automotive industry. U.V. light absorbing stabilizers are also described at pages 2–4 of the Avar et al paper noted below.

Hindered amine light stabilizers (HALS), particularly a nickel quencher combined with two molecules of HALS, give much greater neutralizing power. Again, see Kirk-Othmer, 3rd Edition, Vol. 23, pp. 623–624, the disclosure of which is hereby incorporated by reference. As a class, these materials are well known and have been used since 1974 by the automotive paint industry in combination with selected UV absorbers to stabilize top coat lacquers applied to two-coat metallics or in two-coat nonmetallic enamels.

The proportion of UV light absorber to light stabilizer in the treating formulation may be from 1:1 to 8:1 with a major amount of the UV light stabilizer preferred. Most preferred is a 4:1 ratio.

While not wishing to be bound by any particular theory or mode of operation, it appears that the mechanism of energy dissipation of the ultraviolet absorbers indicates that oxalanilide, because of its double N-H . . . O groups, possesses double the proton transfer capability of the benzophenones and the benzotriazoles. The sterically-hindered, nickel-quenched amines act to neutralize radicals that may produce a thermo- or photo-oxidative process. Mechanisms of energy dissipation of the oxalanilide and hindered amine light stabilizers (for convenience HALS) are described in L. Avar and E. Hess, "New Developments in the Stabilization of Automotive Paints", 1984 Annual Meeting, Federation of Societies for Coating Technologies. The photodecomposition of disperse dyes is described in H. S. Freeman and W. N. Hsu, "Photolytic Behavior of Some Popular Disperse Dyes", Textile Research Journal, Volume 57, No. 4 (1987).

Dyed polyester fabrics protected by the process of this invention are especially suited for use as drapery or automotive fabric materials, exhibiting a degree of UV stability not currently available with conventional UV inhibitors. The combination of ultraviolet inhibitors together with light stabilizers, and optionally selected resins and/or softeners, further improves fabric durability and aesthetics, especially hand and luster, two characteristics in particular demand by the automotive industry. Solvent-soluble silicone polymers having high heat, ultraviolet and discoloration stabilities will provide optimum results. Conveniently, the UV stabilizing finish is applied as a continuous, rapid treatment process which is more efficient and requires less time than the conventional exhaust method.

A convenient way to assess the degree of photodegradation experienced by a dyed polyester textile sample is to use a WeatherOmeter in which a fabric sample is exposed to ultraviolet light, heat and moisture. Dyed polyester fabric meeting the requirements of the present invention will exhibit improved lightfastness and have a lightfastness rating of between 4 and 5 for up to 100 hours in a WeatherOmeter exposure.

The invention is further explained with reference to the following examples in which all parts and percentages are expressed by weight, unless otherwise indicated.

EXAMPLES 1-8

A series of experiments were conducted on woven textured polyester fabric samples which had been dyed under pressure to a dark brown shade, using a mixture of yellow, blue and red low-to medium-energy disperse dyes. These dyes were purposely selected, as they usually exhibit low lightfastness. The results of these experiments, as well as the materials used, are shown in Table 1. In Example 1, no UV absorber was used, since this was a control experiment.

The other 7 samples were treated with an ultraviolet absorber, a hindered-amine light stabilizer, or both, according to the following procedure. The dyed samples were immersed in xylene solution of the listed products, padded to 100% wet pick-up, dried at 200° F., and then thermosoled at 390° F. for 2 minutes. They were then washed for 5 minutes in a bath containing 2 g/L (grams per liter) of soda ash and 1 g/L of nonionic detergent, rinsed, dried, and tested.

Examples 2-4, each using 10-15 g/L of ultraviolet inhibitor, as indicated, are comparative treatments which represent conventional textile industry practice, and thus are not according to the present invention. Examples 5 and 6 employ 2.5 g/L of hindered-amine light stabilizer, and these examples may be considered as controls. Examples 7 and 8 employ a 4:1 combination of UV absorber and light stabilizer, and follow the teachings of the present invention.

TABLE I

Results of WeatherOmeter Exposures of Dyed Fabrics Containing UV Absorbers and Light Stabilizers

| Example No. | Chemical | Concn. | Product Name g/L | Exposure Rating |
|---|---|---|---|---|
| 1 | None (control) | — | — | 2-3* |
| | Ultraviolet Absorbers | | | |
| 2 | Benzotriazole | 15 | Tinuvin 327 | 3-4 |
| 3 | Benzophenone | 15 | Ultrafast 830 | 3* |
| 4 | Oxalanilide | 10 | Sanduvor 3206 | 3* |
| | Light Stabilizers | | | |
| 5 | HALS | 2.5 | Sanduvor 3050 | 3* |
| 6 | Nickel HALS | 2.5 | Sanduvor 3046 | 3* |
| | Ultraviolet Absorber Plus Light Stabilizer | | | |
| 7 | Oxalanilide | 10 | Sanduvor 3206 | 3-4 |
| | HALS | 2.5 | Sanduvor 3050 | |
| 8 | Oxalanilide | 10 | Sanduvor 3206 | 4-5 |
| | Nickel HALS | 2.5 | Sanduvor 3046 | |

*Off-tone color break

All 8 of the fabric samples were assessed for protection from ultraviolet light in an Atlas Electric WeatherOmeter Model Ci65/DMC using General Motors, Inc. Test Specification 9125P.

DISCUSSION OF RESULTS

The light-testing results are shown in Table 1, and the ranges of concentrations of UV absorbers and light stabilizers investigated are given in Table II, below. The UV light-exposed product of Example 8 exhibited an excellent light stability of 4-5, rated by the AATCC Gray Scale Method 1. This sample was developed with a 4:1 oxalanilide/sterically-hindered, nickel-quenched amine (Ni HALS) blend, as indicated. The exposed product of Example 7 exhibited a lower rating of 3-4, but it was free from an off-tone color break. In comparison, conventional fabrics treated with UV inhibitors alone (samples 2-4) showed a 3 or 3-4 AATCC Gray Scale rating with off-tone color breaks, that is, color changes different from the original hues, while the control (untreated) fabric (Example 1) showed poor light stability, in the range of 2-3, as expected. Samples treated with light stabilizers alone (Examples 5 and 6) also showed poor light stability, with AATCC Gray Scale ratings of 3.

Although not used in the above examples, a solvent-soluble silicone polymer exhibiting high heat, UV and discoloration stability may be used to further improve the results.

TABLE II

Concentration Range of Ultraviolet Absorbers and Light Stabilizers Investigated

| Chemical | Product Name | Range g/L | Preferred Range g/L |
|---|---|---|---|
| Benzotriazole | Tinuvin 321 (1) | 2-25 | 10-15 |
| Benzophenone | Ultrafast 830 (2) | 2-25 | 10-15 |
| Oxalanilide | Sanduvor 3206 (3) | 1-20 | 7-10 |
| Hindered amine light stabilizer (HALS) | Sanduvor 3050 (4) | .10-5 | 1.5-2.5 |
| Nickel quenched HALS | Sanduvor 3046 (5) | .10-5 | 1.5-2.5 |

(1) Product of Ciba-Geigy Co.
(2) Product of BASF Co.
(3) Product of Sandoz Chemical Co.
(4) Used in combination with Sanduvor 3206
(5) Used in combination with Sanduvor 3206

What is claimed is:

1. A process for protecting dyed polyester fabrics from photodegradation of the dye and slight to severe color changes in dyed synthetic fabrics, comprising applying to a dyed polyester fabric a photodegradation- and light-stabilizing amount of a combination of at least one organic solvent-soluble UV absorber and at least one organic solvent-soluble hindered amine light stabilizer, the resulting protected fabric having a lightfastness rating of between about 4 and about 5 for up to 100 hours in a WeatherOmeter exposure.

2. The process of claim 1 in which the UV absorber is a benzotriazole.

3. The process of claim 1 in which the UV absorber is a benzophenone.

4. The process of claim 1 in which the UV absorber is an an oxalanilide.

5. The process of claim 1 in which the hindered amine light stabilizer is a nickel-quenched sterically hindered amine.

6. The process of claim 5 in which the UV absorber is oxalanilide.

7. The process of claim 1 in which the combination of light protecting agents is applied in a solution of an organic solvent.

8. The process of claim 7 in which each light protecting agent has a solubility in xylene of at least 200 grams per liter.

9. The process of claim 8 in which the organic solvent is xylene.

10. A process for protecting dyed polyester fabrics from photodegradation of the dye and changes in color both caused by UV light, the process comprising applying to the dyed polyester fabric a photodegradation- and light-stabilizing amount of a combination of at least one organic solvent-soluble oxalanilide UV absorber with at least one organic solvent-soluble hindered amine light stabilizer, the resulting protected fabric having a lightfastness rating of at least 4 following 100 hours WeatherOmeter exposure and devoid of off tone color break.

11. The process of claim 10 in which the light stabilizer is a nickel-quenched sterically-hindered amine.

12. The process of claim 10 in which the ratio of UV absorber:light stabilizer is 1:1 to 1:8.

13. The process of claim 12 in which the ratio of UV absorber: light stabilizer is 1:2 to 1:6.

14. A dyed, ultraviolet light-protected polyester fabric produced by the process of claim 1.

15. A dyed, ultraviolet light-protected polyester fabric produced by the process of claim 10.

16. A dyed, ultraviolet light-protected polyester curtain or drapery produced by the process of claim 1.

17. A dyed, ultraviolet light-protected polyester automotive fabric produced by the process of claim 1.

* * * * *